US005834680A

United States Patent [19]

Nielson et al.

[11] Patent Number: 5,834,680

[45] Date of Patent: Nov. 10, 1998

[54] BLACK BODY DECOY FLARE COMPOSITIONS FOR THRUSTED APPLICATIONS AND METHODS OF USE

[75] Inventors: Daniel B. Nielson; Dean M. Lester, both of Brigham City, Utah

[73] Assignee: Cordant Technologies Inc., Salt Lake City, Utah

[21] Appl. No.: 708,888

[22] Filed: Sep. 5, 1996

Related U.S. Application Data

[60] Provisional application No. 60/004,170, Sep. 22, 1995.

[51] Int. Cl.[6] ..... F42B 4/26; C06B 33/00

[52] U.S. Cl. ..... 102/336; 149/19.9; 149/37; 149/76; 149/108.2

[58] Field of Search ..... 102/336; 149/19.9, 149/37, 76, 108.2

[56] References Cited

U.S. PATENT DOCUMENTS

| | | | |
|---|---|---|---|
| 3,730,093 | 5/1973 | Cummings | 102/6 |
| 3,770,526 | 11/1973 | Sayles | 149/22 |
| 3,924,405 | 12/1975 | Cohen et al. | 60/219 |
| 4,221,617 | 9/1980 | Rudy et al. | 149/19.5 |
| 4,658,578 | 4/1987 | Shaw | 60/205 |
| 4,798,637 | 1/1989 | Hendrickson | 149/20 |
| 4,812,180 | 3/1989 | Sayles | 149/19.5 |
| 4,881,464 | 11/1989 | Sayles | 102/336 |
| 5,180,452 | 1/1993 | Lund et al. | 149/19.9 |
| 5,389,308 | 2/1995 | Busel et al. | 252/587 |
| 5,472,532 | 12/1995 | Wallace, II | 149/12.4 |
| 5,529,648 | 6/1996 | Stickler | 149/19.1 |

*Primary Examiner*—Peter A. Nelson
*Attorney, Agent, or Firm*—Pillsbury Madison & Sutro LLP; Ronald L. Lyons

[57] ABSTRACT

This invention relates to the production of black body-generating decoy flares for thrusted applications. Compositions are provided which, when combusted, provide black body radiation. The compositions generally include from about 20% to about 60% metal, such as magnesium or aluminum, from about 5% to about 50% ammonium perchlorate, and from about 8% to about 30% binder. Important to operation of the present invention is the production of graphitized carbon upon combustion of the composition. Accordingly, high carbon content materials are added to the compositions. These materials may include from about 5% to about 30% polyaromatic compounds, such as decacyclene, anthracene, and naphthalene. Other suitable high carbon materials include polyolefins. This invention also discloses methods of using these compositions in thrusted decoy flare applications.

40 Claims, 3 Drawing Sheets

BLACK BODY DECOY FLARE COMPOSITIONS FOR THRUSTED APPLICATIONS AND METHODS OF USE

RELATED APPLICATIONS

This application is related to United States Provisional Application of Daniel B. Nielson and Dean M. Lester, Ser. No. 60/004,170, filed Sep. 22, 1995 and entitled "Compositions for Producing Black Body Radiation", which provisional application is incorporated herein by this reference.

FIELD OF THE INVENTION

The present invention is related to compositions that produce black body radiation when ignited. More particularly, the present invention is related to such compositions that are also capable of serving in decoy flares and that are further capable of producing significant thrust for propelling such decoy flares.

BACKGROUND OF THE INVENTION

Aircraft-launched flares of various types have been used for many purposes. For example, it is often desirable to light a particular area at night. A flare may be used to produce light for search and rescue operations or for various military purposes. It is also well known to employ flares as a decoy tactic. That is, a flare may be used to cover the path of an aircraft through a particular area. One common situation would be when the aircraft is encountering anti-aircraft fire. The use of a flare can distract the anti-aircraft fire sufficiently to allow the aircraft to proceed safely on its course.

Anti-aircraft missiles are commonly used in modern warfare. Such missiles may be launched from the ground or they may be launched from another aircraft. Many of this type of missile are designed to seek particular types of emissions characteristic of aircraft. Such emissions often take the form of heat and infrared light. Thus, "heat-seeking" missiles are often used against aircraft.

In this context, it is desirable to provide a flare that produces the type of emissions sought by the missile in order to distract the missile from the actual aircraft. Thus, flares that emit heat and infrared are well known and have been used for many years.

One of the problems with the typical flare, however, is that the flare is simply ejected out of the aircraft's flare dispenser. The flare is then ignited and burns as it falls. It is hoped that any heat- or infrared-seeking missiles in the area will follow the flare and not the aircraft. However, because the flare is not independently propelled, the flight path of the flare and the aircraft are significantly different. The flare essentially falls in an arc to the ground while the aircraft continues on its chosen course.

This method has proven disadvantageous. It may be possible for the missile, or for the individual or mechanism launching the missile, to discriminate between the falling flare and the aircraft. In addition, a difference between the speed of travel of the aircraft and the speed of the flare rapidly develops. Since the typical flare is not propelled, the aircraft will quickly leave the flare behind.

Conventional decoy flare materials have been a combination of magnesium and teflon. This formulation produces an emission spectrum that is more intense but not spectrally matched to that of a jet engine. Modern anti-aircraft missiles are often capable of discriminating between the emission signature of a magnesium-teflon decoy and an actual aircraft engine. Accordingly, these compositions are becoming less and less effective.

An additional problem with magnesium-teflon compositions is that they are very sensitive. As a result, processing and handling these compositions is dangerous and has resulted in many injuries and even deaths.

An additional problem with magnesium-teflon compositions is that they burn at a very high temperature. As a result, it is difficult to contain these compositions in a flare case. The high combustion temperatures result in the case being burned through. For this reason it is conventional to simply have the aircraft drop open burning flare grains composed of magnesium/teflon without cases.

In addition, the manner in which the flare burns has proven to be a limitation. The typical flare burns from the outside toward its center. In essence, the flare burns in the same general manner as a match. This burn mechanism, however, does not allow precise control over the output produced. In addition, it may be difficult to adequately ignite the flare for deployment.

Accordingly, it would be a significant advancement in the art to provide a flare for deployment by an aircraft that overcame the identified problems of the typical flare. In particular, it would be an advancement to provide a flare that was able to travel at a selected speed and over a selected course.

It would also be an advancement in the art to provide such a flare that produced a selected spectrum of output such that it could act as an effective decoy. In particular, it would be an advancement to provide such a flare that produced a selected infrared output. It would be a further advancement in the art to provide such a flare which was capable of burning within an internal combustion chamber, rather than in the typical outside-in manner.

Such flare compositions are disclosed and claimed herein.

SUMMARY AND OBJECTS OF THE INVENTION

The present invention is related to new compositions that produce black body radiation when ignited. A black body radiator is generally defined as a material that radiates over a broad spectrum, as described by the following equation:

$$M=\epsilon\sigma T^4 \text{ Wcm}^{-2}$$

where:

$\epsilon$=emissivity

T=absolute temperature $\sigma$=Stefan-Boltzmann constant

M=exitance

The black body decoy flare compositions for thrusted applications defined herein function in a manner similar to traditional magnesium-teflon infrared decoy flares. Heat produced by the flare decoys the heat-seeking missile away from the target. The principle difference is that the primary oxidizer of the conventional magnesium teflon flare is teflon. When teflon is reacted with magnesium, a very hot (3000°–3700° K) combustion takes place. The primary reaction products of a conventional magnesium-teflon flare are solid carbon and liquid magnesium fluoride. The high emissivities of these reaction products result in an efficient black body radiating plume. Although these reaction products are effective radiators, they are not gaseous and therefore are not suitable to produce the thrust required for a kinematic flare. The novel approach of the present invention uses ammonium perchlorate as the primary oxidizer. This well-characterized solid rocket fuel oxidizer produces hot (3000° K) gaseous reaction products when combusted with magnesium. These gaseous reaction products are ideal for producing thrust in a kinematic flare. These products, however, have low emissivities and are not efficient black body radiators. In addition, the high reaction temperatures are difficult to contain in metal thrusted flare housings.

In order to deal with the problems of high temperature and inefficient black body radiation, the present invention teaches the addition of anthracene, decacyclene, naphthalene, or other high carbon-containing material to the pyrotechnic composition. These materials produce graphitized carbon particles during pyrolysis. The addition of such materials also results in a cooling effect in the combustion chamber and an efficient black body radiator in the exhaust plume. The combustion temperature is generally below 3000° K, typically in the range of about 2200° K.

Materials such as anthracene, decacyclene and naphthalene, are multiple aromatic ring compounds. These materials are employed as additives to the magnesium/ammonium perchlorate thrusted grain. The aromatic rings are reduced to graphite in the fuel-rich composition, producing an ideal incandescent species. The addition of the graphite-forming species significantly increases the observed black body radiation. These materials also result in a cooling action in the combustion chamber, allowing the thrusted decoy hardware to survive without insulation. Insulation is not generally desirable because it reduces the mass fraction of pyrotechnic to case hardware and results in an overall loss of efficiency.

These and other objects and advantages of the invention will become apparent upon reading the following detailed description and appended claims, and upon reference to the accompanying drawings.

DETAILED DESCRIPTION OF THE PREFERRED EMBODIMENTS

Figure 1:
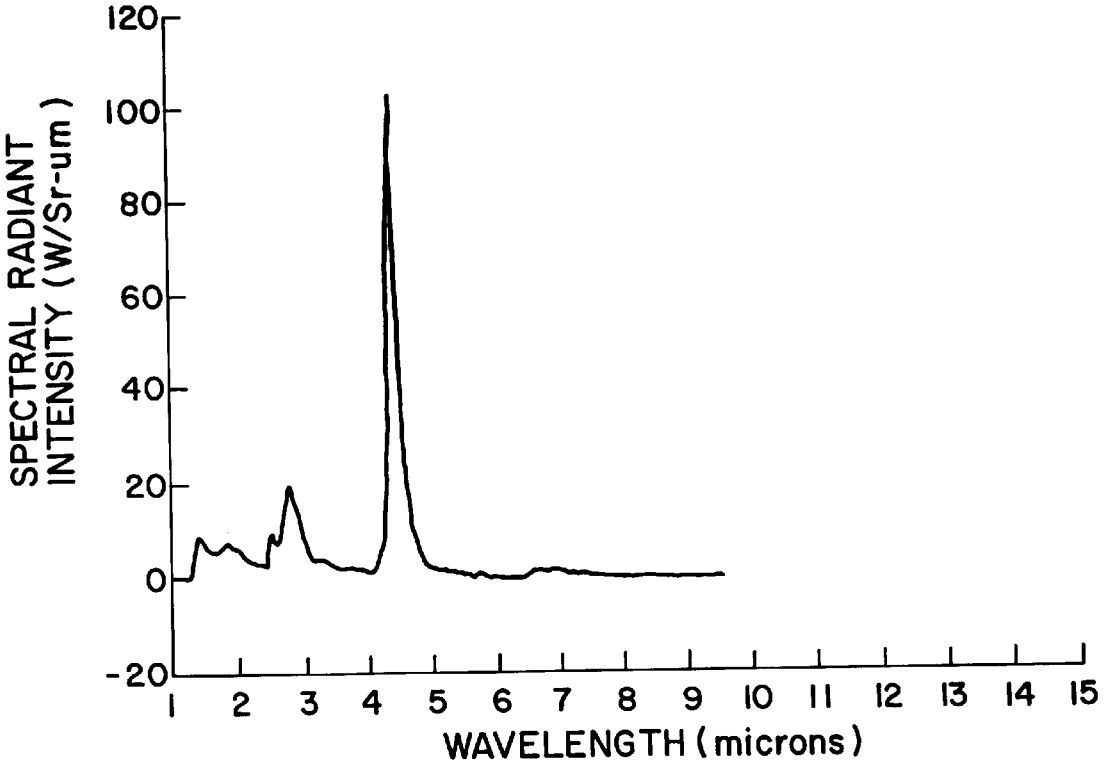
FIG. 1 is a graph illustrating the emissions spectrum generated by burning a magnesium/ammonium perchlorate composition that contains no polyaromatic compounds.

The present invention provides improved black body generating compositions. The compositions are capable of producing significant amounts of black body radiation. At the same time, the formulations avoid some of the problems encountered with conventional flare compositions, including the use of teflon and other halocarbons as oxidizers. Additionally, the compositions are capable of producing thrust.

Accordingly, the compositions of the present invention comprise a metal fuel, ammonium perchlorate as the main oxidizer, a binder, and high carbon content compounds. Other additives, including plasticizers, curing agents, and burn rate modifiers are used as is known in the art to tailor other characteristics of the composition. Additionally, the compositions of the present invention are essentially free of teflon and other halocarbons. In summary, the present invention provides new and useful black body flare compositions that may be used for thrusted applications.

A typical flare composition according to the present invention includes the following components in the following percentages by weight:

| Ingredient | Weight Percent |
|---|---|
| Magnesium | 20 to 60 |
| Ammonium Perchlorate | 5 to 50 |
| Binder (Hydroxy-terminated polybutadiene (R-45M); BAMO/AMMO; polyolefin thermoplastics (EVA); or PNC) | 8 to 30 |
| Anthracene or Decacyclene | 5 to 30 |
| Isopherone diisocyanate (IPDI) | 0 to 1.3 |
| Triphenyl bismuth (TPB) | 0 to 0.02 |
| HX 752 | 0 to 0.5 |
| Dioctyl adipate (DOA) | 0 to 5 |
| Iron Oxide ($Fe_2O_3$) | 0 to 0.7 |

Magnesium is the fuel of choice, although other metals, such as aluminum and mixtures of aluminum and magnesium, could also be used. Magnesium is easily ignited and has a strong capability to after-burn in the plume behind the flare. This after-burning is important to augment the infrared signature of the plume without increasing the combustion chamber's internal temperature. It is presently preferred that the metal be in the range of from about 20% to about 60% by weight. Most formulations falling within the scope of the present invention will have metal in the range of from about 20% to about 40% by weight.

In conventional magnesium-teflon flare compositions, teflon (polyfluoroethylene) is the oxidizer. When magnesium and teflon are reacted, the combustion takes place at temperatures in the range of about 3000° K to about 3700° K. These reaction temperatures may be too hot to avoid burn-through of the flare case. Moreover, the primary reaction products of magnesium-teflon flares are solid carbon and liquid magnesium fluoride. Although these products are efficient radiators, they are not gaseous and are not suitable to produce thrust. By contrast, the flare compositions of the present invention are substantially free of teflon and other halocarbons, including chlorinated benzene compounds, polyvinylidene fluoride, chloroparaffin, and octaflurohexanediol.

The oxidizer of choice is ammonium perchlorate because it oxidizes readily, producing gaseous reaction products. These gaseous products are required for the thrusting component of the flare. Ammonium perchlorate is a well-characterized solid rocket fuel oxidizer. It is presently preferred that ammonium perchlorate be present from about 5% to about 60% by weight. Generally good results have been obtained with formulations in which ammonium perchlorate is present from about 30% to about 50% by weight.

The flare formulations also include a binder. In certain preferred formulations, the binder is a typical hydroxy-terminated polybutadiene (HTPB) system. It is presently preferred that the binder be present at from about 8% to about 30% by weight. More particularly, the binder is present in the range of from about 10% to about 20% by weight. Generally good results have been obtained with formulations in which the binder is present at about 14% by weight.

Energetic polymeric binder compositions, such as polyoxetane binders, may also be used. Preferred polyoxetanes include random copolymers of poly(3,3-bis(azidomethyl) oxetane (BAMO) and 3-azidomethyl-3-methyl oxetane (AMMO). Random copolymers of this type will be referred to herein as "poly(3,3-bis(azidomethyl) oxetane-co-random-3-azidomethyl-3-methyl oxetane" or "BAMO/AMMO." It is preferred that the copolymer comprise from about 50 mole % to about 70 mole % BAMO and from about 30 mole % to about 50 mole % AMMO. In one preferred embodiment of the present invention, the random copolymer comprises from about 60 mole % BAMO and about 40 mole % AMMO. The binder may also be comprised of plastisol nitrocellulose (PNC) or polyolefin thermoplastics such as ethylene vinyl acetate (EVA, available from Dow Chemical).

Figure 2:
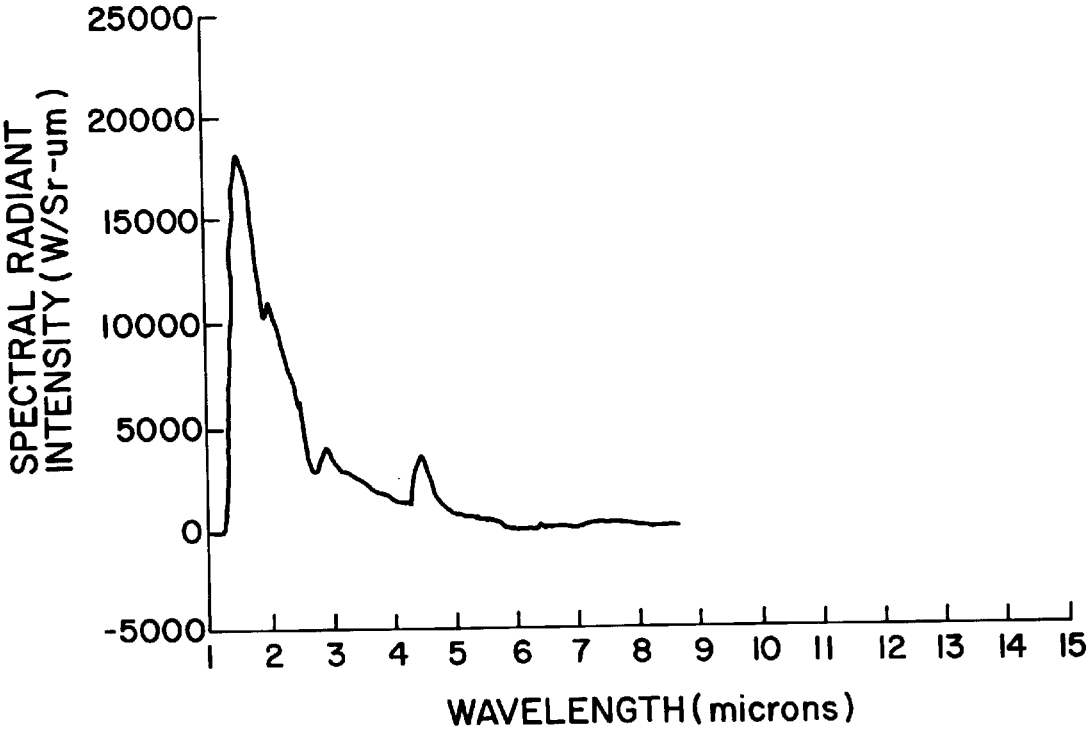
FIG. 2 is a graph illustrating the emissions spectrum generated by burning a composition within the scope of the invention.

The flare formulations also include a high carbon content additive. When ammonium perchlorate combusts with magnesium it produces high temperature (about 3000° K) gaseous reaction products. The pyrolysis of high carbon-containing compounds cools the combustion chamber (typically to about 2200° K), allowing the kinematic decoy to survive without insulation. In any event, the combustion temperature is below 3000° K, and preferably in the 2000° K to 3000° K range. Furthermore, the gaseous reaction products generated by combusting magnesium with ammonium perchlorate are not efficient black body radiators. As illustrated in FIG. 1, a magnesium/ammonium perchlorate composition that contains no high carbon-containing compounds burns to produce a selective emissions signature and is a poor black body radiator. The addition of high carbon-containing compounds to the pyrotechnic composition produces graphitized carbon particles during pyrolysis, generating an efficient black body radiator in the exhaust plume. As illustrated in FIG. 2, a magnesium/ammonium perchlorate composition that contains 10% anthracene burns to produce a broad emissions spectrum and is an efficient black body radiator.

Preferred high carbon-containing compounds include multiple aromatic ring compounds, or "polyaromatic compounds," such as anthracene, decacyclene, and naphthalene. Other suitable high carbon-containing compounds include polyolefins. Indeed, hydroxy-terminated polybutadienes (HTPBs) could be used to provide carbon to the composition. In a typical formulation, a polyaromatic compound is present from about 5% to about 30% by weight. More particularly, a polyaromatic compound is present in the range of from about 10% to about 20% by weight. Generally good results have been obtained using anthracene or decacyclene in the range of from about 10% to about 15% by weight.

In some preferred embodiments, fuels, oxidizers, and binders are chosen such that a castable or extrudable flare formulation is produced. Typical end of mix viscosities are less than approximately 20 kilopoises. These characteristics substantially reduce cost and ease manufacturing.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLES 1–5

Figure 3:
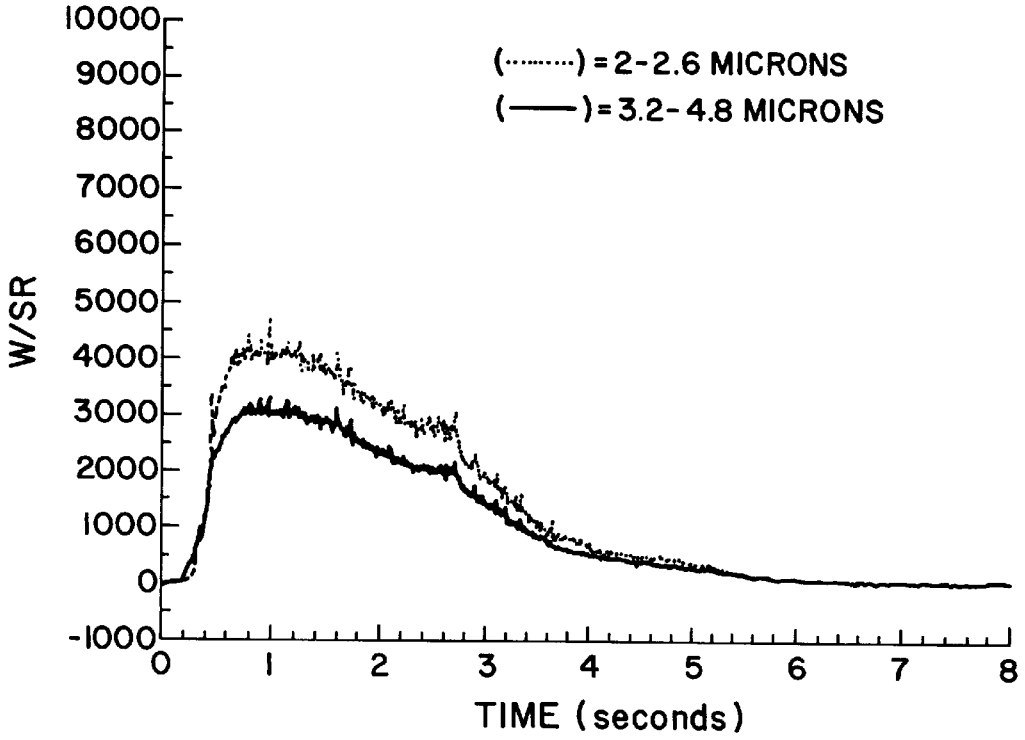
FIG. 3 is a graph illustrating the intensity of emissions within two specified ranges of wavelengths generated by burning a composition within the scope of the invention versus time.

Table I sets forth a series of mixes of formulations within the scope of the present invention. A control composition (designated herein as the "Control") containing magnesium and ammonium perchlorate but no high carbon content compounds was tested, along with several compositions that contained from about 10% to about 15% by weight anthracene or decacyclene (designated herein as Examples 1–5) and a teflon-containing composition (designated herein as the "Teflon Formulation"). As illustrated in FIG. 1, the Control, which contains no high carbon compounds and is within the scope of the prior art, burns to produce a selective emissions signature and is a poor black body radiator. By comparison, the magnesium/ammonium perchlorate composition given in Example 1 contains 10% anthracene and burns to produce a broad emissions spectrum as shown in FIG. 2. FIG. 3 is a graph illustrating the intensity of emissions within two specified ranges of wavelengths generated by burning the composition given in Example 1 versus time. The data in FIGS. 2 and 3 demonstrate that this composition is capable of producing black body radiation. FIGS. 2 and 3 are representative of data obtained from several tests using compositions within the scope of the invention.

TABLE I

Composition of Test Formulation

| | | Example Number | | | | | Teflon |
|---|---|---|---|---|---|---|---|
| Material | Control | 1 | 2 | 3 | 4 | 5 | Formulation |
| R45-M | 13.77 | 14 | 14 | 14 | 14 | 14 | 14 |
| IPDI | 0.92 | 1.1 | 1.1 | 1.1 | 1.1 | 1.1 | 1.1 |
| TPB | 0.02 | 0.02 | 0.02 | 0.02 | 0.02 | 0.02 | 0.02 |
| HX 752 | 0.3 | 0.3 | 0.3 | 0.3 | 0.3 | 0.3 | 0.3 |
| $Fe_2O_3$ | — | 0.5 | 0.5 | 0.5 | 0.5 | 0.5 | 0.5 |
| DOA | — | 2.0 | 2.0 | 2.0 | 2.0 | 2.0 | 2.0 |
| Magnesium | 22 | 29.5 | 36.5 | 26 | 33 | 28 | 22 |
| AP | 63 | 42.58 | 35.58 | 41.08 | 34.08 | 39.38 | 29 |
| Anthracene | — | 10 | 10 | 15 | 15 | — | — |
| Decacyclene | — | — | — | — | — | 15 | 10 |
| Teflon | — | — | — | — | — | — | 21.4 |

Table II sets forth the intensity of emissions within two specified ranges of wavelengths generated by burning the compositions. These data are exemplary and selected from a series of tests.

TABLE II

Emissions Within Selected Wavelength Ranges

| Formulation | 3.2–4.8 $\mu$m W/Sr | 2.0–2.6 $\mu$m W/Sr |
|---|---|---|
| Control | — | — |
| Teflon Formulation* | 8,994 | 10,267 |
| Example 1 | 6,186 | 8,185 |
| Example 2 | 8,896 | 11,705 |
| Example 3 | 8,648 | 11,390 |
| Example 4 | 11,607 | 15,377 |
| Example 5 | 9,325 | 11,261 |

*These materials burned holes in the stainless steel test hardware.

Typical end of mix viscosities are presented in Table III for several of the compositions. These viscosities ranged from about 8.8 Kp to about 9.6 Kp. All of the formulations contained HTPB binder systems and were mixed in a Baker Perkins overhead mixer. These compositions could also be formulated in a twin screw extruder and the HTPB binder system could be replaced with a number of binder systems including thermoset and thermoplastic materials.

TABLE III

| Material | Viscosity Example 1 | Example 2 | Example 3 |
|---|---|---|---|
| Kilopoises | 8.8 | 9.6 | 8.8 |

Figure 4:
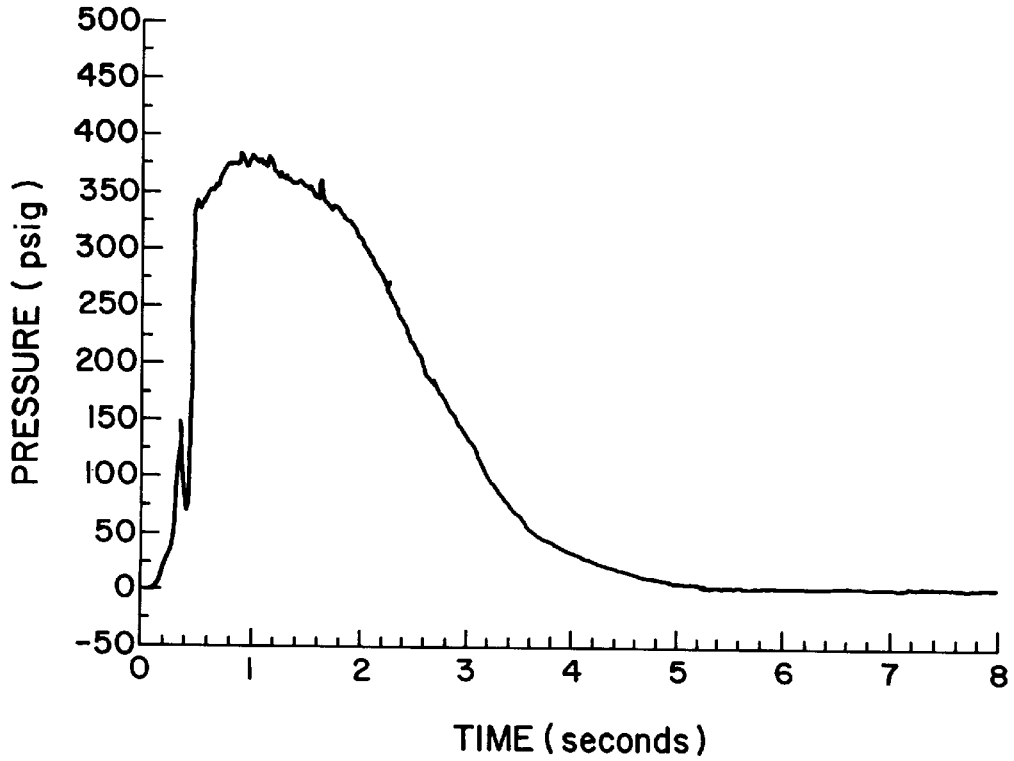
FIG. 4 is a graph illustrating the pressure generated by burning a composition within the scope of the invention.

The compositions disclosed herein are also capable of producing thrust. FIG. 4, for example, is a graph illustrating the thrust generated by burning the composition given in Example 1. These data demonstrate that the composition is capable of producing thrust. FIG. 4 is representative of data obtained from several tests using compositions within the scope of the invention.

Figure 5:
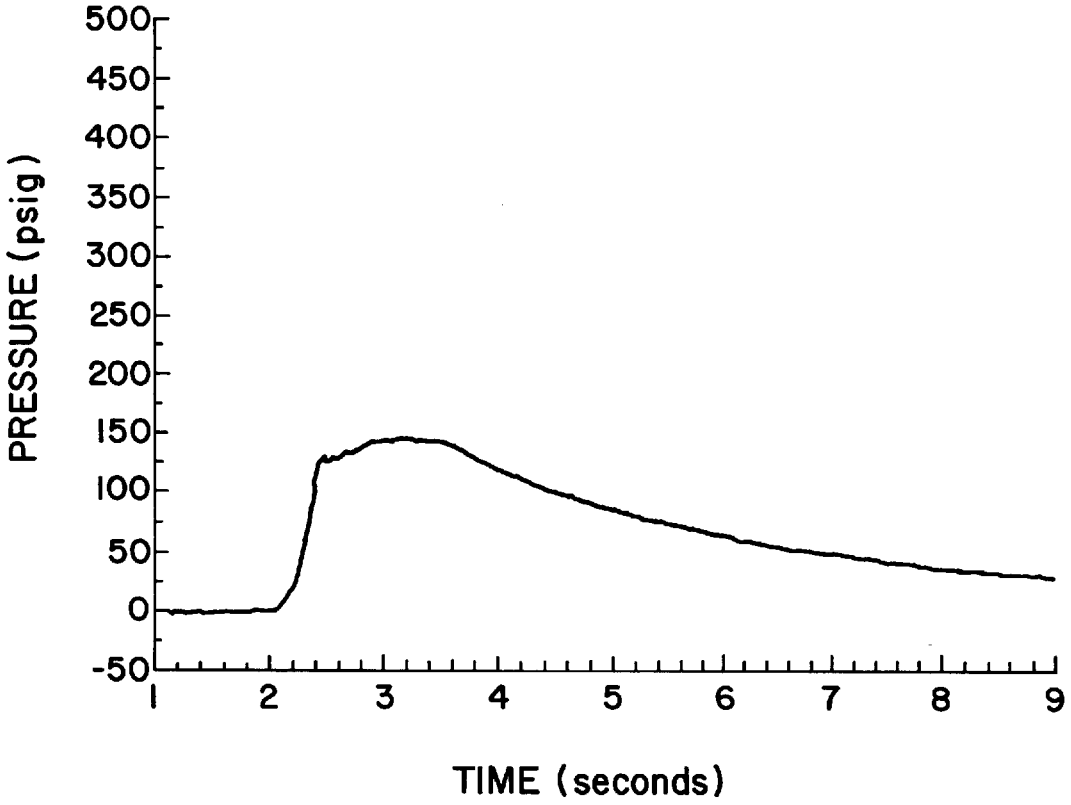
FIG. 5 is a graph illustrating the pressure generated by burning a magnesium/teflon/decacyclene composition.

FIG. 5 is a graph illustrating the thrust generated by the Teflon Formulation. These data demonstrate that the teflon-containing composition generates substantially less thrust (maximum pressure of approximately 150 psig in about 2½ seconds) than the teflon-free composition shown in FIG. 4 (maximum pressure of almost 400 psig in less than 1 second).

SUMMARY

In summary, the present invention provides new and useful flare compositions that produce significant amounts of black body radiation. These compositions also produce gaseous emission products and are, therefore, suitable for thrusted applications. Such compositions overcome some of the major drawbacks of decoy flare compositions. Thus, the flare compositions of the present invention represent a significant advancement in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An ignitable black-body radiation-generating composition, said composition formulated from constituents comprising:

a metal selected from the group consisting of magnesium, aluminum, and mixtures thereof, said metal being present from about 20% to about 60% by weight;

from about 20% to about 50% by weight of ammonium perchlorate;

a polyaromatic compound, said polyaromatic compound being present from about 5% to about 30% by weight, wherein the composition is substantially free of halocarbons and burns in a temperature range of from about 2000° K to about 3000° K.

2. A composition as defined in claim 1, wherein the polyaromatic compound is selected from the group consisting of decacyclene, anthracene, and naphthalene.

3. A composition as defined in claim 1, wherein said constituents further comprise a polyolefin compound, said polyolefin compound being present from about 5% to about 30% by weight.

4. A composition as defined in claim 1, wherein the composition has an end of mix viscosity of less than 20 kilopoises.

5. A composition as defined claim 1, wherein said constituents further comprise a burn-rate modifier, said burn-rate modifier being present from about 0.1% to about 1.5% by weight.

6. A composition as defined in claim 1, wherein said constituents further comprise a plasticizing agent, said plasticizing agent being present from about 0% to about 5% by weight.

7. A composition as defined in claim 1, wherein the binder consists essentially of a hydroxy-terminated polybutadiene (HTPB).

8. A composition for producing black body radiation, said composition formulated from constituents comprising:

a metal selected from the group consisting of magnesium, aluminum, and mixtures thereof, said metal being present from about 20% to about 60% by weight;

ammonium perchlorate, said ammonium perchlorate being present in an amount from about 20% to about 50% by weight;

a binder, said binder being present from about 8% to about 30% by weight, said binder comprising a hydroxy-terminated polybutadiene (HTPB); and a polyaromatic compound, said polyaromatic compound being present from about 5% to about 30% by weight, wherein the composition is substantially free of halocarbons.

9. A composition as defined in claim 8, wherein the polyaromatic compound is selected from the group consisting of decacyclene, anthracene and naphthalene.

10. A composition as defined in claim 8, wherein the composition burns in the range of about 2000° K to about 3000° K.

11. A method of diverting anti-aircraft missiles comprising the steps of:

providing at least one flare capable of emitting a black body radiation, said flare containing an ignitable mixture formulated from at least one metal selected from the group consisting of magnesium and aluminum; ammonium perchlorate; at least one high carbon content compound; and a binder, said flare being a thrustable flare, and said flare emitting black body radiation when said mixture is ignited, wherein said mixture can burn at a temperature in a range of from about 2000° K to about 3000° K;

igniting and launching the flare against an anti-aircraft missile.

12. A method as defined in claim 11, wherein the mixture has an end of mix viscosity of less than 20 kilopoises.

13. A method as defined in claim 11, wherein the mixture is castable using traditional solid rocket fuel vacuum casting techniques.

14. A method as defined in claim 11, wherein the mixture is substantially free of halocarbons.

15. A method as defined in claim 11, wherein a plasticizing agent is included when said mixture is being formulated.

16. A method as defined in claim 11, wherein the high carbon content compounds are selected from the group consisting of decacyclene, anthracene, naphthalene, and polyolefin.

17. A method as defined in claim 16, wherein the mixture is substantially free of halocarbons.

18. A method of producing a thrusted flare comprising the steps of:

providing a composition comprising a metal selected from the group consisting of magnesium, aluminum, and mixtures thereof, said metal being present from about 20% to about 60% by weight;

ammonium perchlorate present from about 20% to about 50% by weight; and a binder, said binder being present from about 8% to 30% by weight;

a polyaromatic compound, said polyaromatic compound being present from about 5% to about 30% by weight;

wherein the composition is substantially free of halocarbons and burns in the temperature range of from about 2000° K to about 3000° K; and loading the mixture into a case configured such that when the mixture is ignited, the flare is propelled and emits a black body spectrum.

19. A method as defined in claim 18, wherein the polyaromatic compound is selected from the group consisting of decacyclene, anthracene, naphthalene, and polyolefin.

20. A method of deploying a thrusted decoy flare, said thrusted decoy flare containing a composition formulated from ingredients which comprise at least one metal selected from the group consisting of magnesium and aluminum, ammonium perchlorate at least one and high carbon content compound, said method comprising deploying said thrusted decoy flare and burning said composition, such that when said burning occurs, gaseous reaction products are produced and the temperature of combustion is in a range of from about 2000° K to about 3000° K.

21. A method as defined in claim 20, wherein the burning occurs in an environment that is essentially free of halocarbons.

22. A method as defined in claim 20, wherein the burning occurs in the presence of high carbon content materials selected from the group consisting of decacyclene, anthracene, naphthalene and polyolefin.

23. A method as defined in claim 22, wherein the burning occurs in an environment that is essentially free of halocarbons.

24. A black body decoy flare comprising:

a flare casing;

a composition disposed within said flare casing comprising:

a metal selected from the group consisting of magnesium, aluminum, and mixtures thereof, said metal being present from about 20% to about 60% by weight;

ammonium perchlorate present from about 20% to about 50% by weight;

a binder, said binder being present from about 8% to 30% by weight, and a polyaromatic compound, said polyaromatic compound being present from about 5% to about 30% by weight;

wherein the composition is substantially free of halocarbons; and burns in the temperature range of from about 2000° K to about 3000° K.

25. A black body decoy flare defined in claim 24, wherein the composition has an end of mix viscosity of less than 20 kilopoises.

26. A black body decoy flare defined in claim 24, further comprising a burn-rate modifier, said burn-rate modifier being present from about 0.1% to about 1.5% by weight.

27. A black body decoy flare defined in claim 24, further comprising a plasticizing agent, said plasticizing agent being present from about 0% to about 5% by weight.

28. A black body decoy flare defined in claim 24, wherein the binder consists essentially of a hydroxy-terminated polybutadiene.

29. A composition as defined in claim 1, wherein the metal is present in an amount from about 20% to 40% by weight.

30. A composition as defined in claim 1, wherein said composition contains 30% to 50% by weight of ammonium perchlorate.

31. A composition as defined in claim 1, wherein said binder is present in an amount from about 10% to 20% by weight.

32. A composition as defined in claim 1, wherein said binder comprises an energetic binder.

33. A composition as defined in claim 1, wherein said polyaromatic compound is present in an amount of 10% to about 20% by weight.

34. A composition as defined in claim 33, wherein said polyaromatic compound is present in an amount from about 10% to about 15% by weight.

35. A composition as defined in claim 2, wherein said polyaromatic compound is present in an amount of 10% to about 20% by weight.

36. A composition as defined in claim 1, wherein said metal is magnesium.

37. A composition as defined in claim 35, wherein said polyaromatic compound comprises anthracene or decacyclene.

38. A composition as defined in claim 36, wherein said polyaromatic compound is present in an amount from about 10% to about 15% by weight.

39. A composition as defined in claim 1, wherein said composition is formulated with up to 5% by weight of plasticizing agent, from 0.1% to about 1.5% by weight of a burn rate modifier, and a polyaromatic compound selected from the group consisting of decacyclene, anthracene and naphthalene.

40. A castable or extrudable black-body flare composition formulated from constituents including about 20% to about 60% by weight of at least one metal selected from the group consisting of magnesium and aluminum; from about 20% to about 50% by weight of ammonium perchlorate; from about 8% to about 30% by weight of a binder; and from about 5% to about 30% by weight of a material producing graphitized carbon particles during pyrolysis of the composition, said material comprising a high carbon content compound, wherein said composition is essentially free of halocarbons, said composition being formulated to burn in a temperature range of about 2000° K to about 3000° K and to emit black body radiation.

* * * * *